US006619001B1

(12) United States Patent
Pratt

(10) Patent No.: US 6,619,001 B1
(45) Date of Patent: Sep. 16, 2003

(54) METHODS OF USE OF A BASEMENT WATER DRAINAGE CONDUIT

(76) Inventor: James M. Pratt, P.O. Box 920624, Needham, MA (US) 02492

( * ) Notice: Subject to any disclaimer, the term of this patent is extended or adjusted under 35 U.S.C. 154(b) by 0 days.

(21) Appl. No.: 10/369,232

(22) Filed: Feb. 20, 2003

Related U.S. Application Data

(62) Division of application No. 10/033,567, filed on Jan. 2, 2002.

(51) Int. Cl.[7] ..... E02D 19/00
(52) U.S. Cl. ..... 52/169.5; 52/302.1
(58) Field of Search ..... 52/302.1, 302.2, 52/302.3, 302.4, 302.5, 302.6, 302.7, 169.1, 169.2, 169.3, 169.4, 169.5, 169.6, 169.7, 169.8, 169.9, 169.13

(56) References Cited

U.S. PATENT DOCUMENTS 1,360,774 A * 11/1920 Mooney et al. ..... 52/731.2
2,941,635 A * 6/1960 Harris ..... 52/634
3,977,149 A * 8/1976 Haynes et al. ..... 52/732.1
4,171,598 A * 10/1979 Holmes ..... 52/118
5,501,044 A * 3/1996 Janesky ..... 52/169.5
5,715,643 A * 2/1998 Parkinson ..... 52/656.9
5,765,323 A * 6/1998 Bevilacqua ..... 52/169.5
6,052,959 A * 4/2000 LaBrosse ..... 52/302.6
6,202,366 B1 * 3/2001 Snyder et al. ..... 52/97

* cited by examiner

*Primary Examiner*—Jeanette Chapman
(74) *Attorney, Agent, or Firm*—William Nitkin

(57) ABSTRACT

Methods of use of a conduit are disclosed for installation under the floor of a basement for the removal of water therefrom, such conduit having an elongated structure of rectangular cross section and having a vertically disposed inside wall 2 inches in height, a vertically disposed outside wall 2 inches in height, a top wall horizontally disposed of approximately 3½ inches in length joining the tops of such inside and outside walls, and a bottom wall horizontally disposed of approximately 3½ inches in length joining the bottoms of such inside and outside walls, a plurality of elongated apertures defined in the inside wall, each approximately ½ inch in height and 1¾ inches in length and spaced approximately 2 inches apart, and a plurality of elongated apertures defined in the outside wall, each aperture approximately ½ inch in height and 1¾ inches in length and spaced approximately 2 inches apart and spaced approximately 2 inches apart from one another, and a pair of engagement members extending upwards from said top wall and extending along the length of the conduit, each engagement member being approximately 1/10 inch in width and ¼ inch in height.

5 Claims, 4 Drawing Sheets

METHODS OF USE OF A BASEMENT WATER DRAINAGE CONDUIT

This application is a divisional of my previously filed patent application entitled Basement Water Drainage Conduit and Methods of Use Thereof, Ser. No. 10/033,567 filed Jan. 2, 2002 now pending which was based on a provisional patent application of the same title having Ser. No. 60/255,792 filed Dec. 18, 2000.

BACKGROUND OF THE INVENTION

1. Field of the Invention

The field of this invention resides in the area of basement water drainage subfloor conduits and more particularly relates to an elongated, substantially rectangular in cross section drainage conduit and the methods of use thereof.

2. Description of the Prior Art

Structures to prevent or redirect water seepage from passing into a basement through or under a foundation wall have been utilized in the past. Many of such structures utilize a barrier disposed against the foundation to direct the water down to drainage systems in the floor. Conduits have also been used that provide for water collection and for the creation of a diversion space formed at the junction of the foundation wall and footing. Some of such conduits are substantially rectangular but the bottom portion of its inside wall, which is positioned adjacent to the foundation wall, is disposed at an angle to create such water collection space. U.S. Pat. No. 5,501,044 is an example of such prior art device.

SUMMARY OF THE INVENTION

It is a goal of this invention to provide an improved conduit and methods of use thereof to aid in draining water that might otherwise seep into basement areas. The conduit of this invention is made of a water-impermeable material and is positioned below the basement floor near, or adjacent to, the foundation wall in various single-conduit or dual-conduit arrangements, as described below. The conduit has a plurality of elongated apertures defined in its sides, as described below, and such water passes through such apertures into the conduit where it is carried by the conduit to a distant location, preventing such water from leaking into the basement.

It is a further object of this invention to teach a number of methods of installation of such conduit in various foundation configurations. Some configurations include a footing beneath the foundation wall while another teaches the use of the conduit of this invention in structures where there is no footing but merely gravel under the foundation wall and flooring. In a prime embodiment dual conduits can be utilized with the first conduit located adjacent to the foundation and the second conduit located adjacent to the footing, as described further below.

It has been found that the use of the conduit of this invention under the perimeter of a basement floor substantially simplifies the construction arrangements and yet provides good drainage to prevent water seepage into the basement. The use of the conduit of this invention can also be retrofitted into existing constructions.

DESCRIPTION OF THE PREFERRED EMBODIMENT(S)

Figure 1:
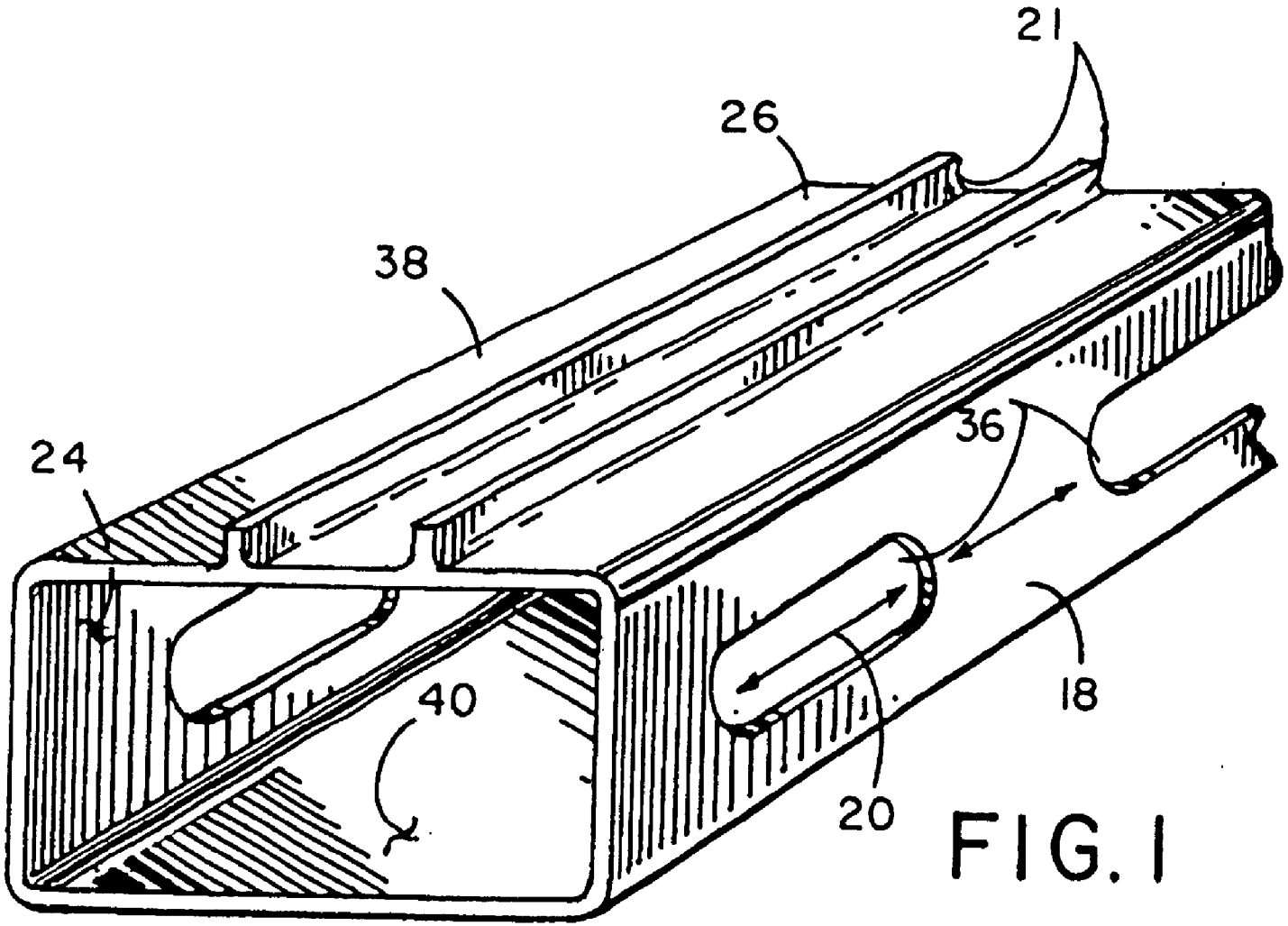
FIG. 1 illustrates a perspective view of the conduit of this invention.
Figure 2:
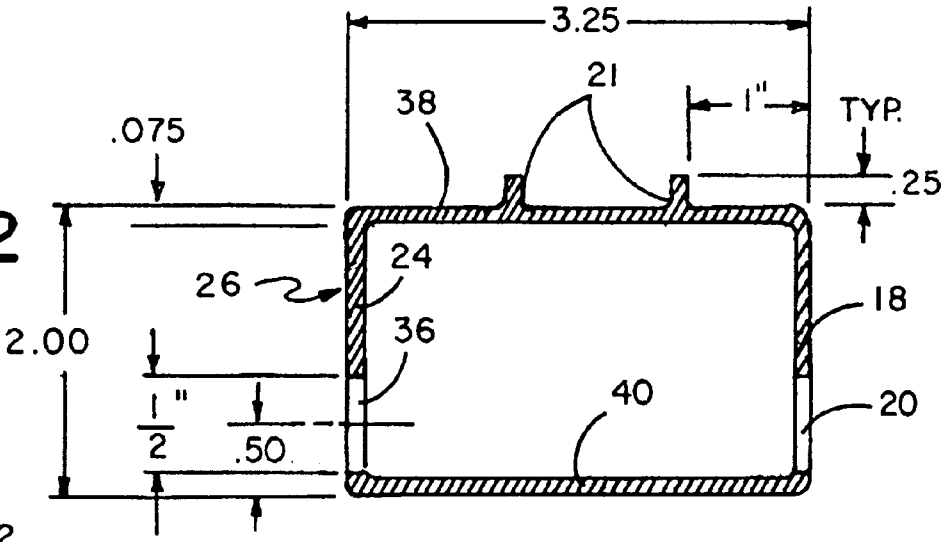
FIG. 2 illustrates a cross-sectional view through the conduit of FIG. 1.

Applicant has developed an improved basement water drainage conduit and methods of use thereof that do not require the formation of a water collection space against the foundation wall. Applicant's conduit 26, as seen in the perspective view of FIG. 1 and the cross-sectional view of FIG. 2, has top wall 38 and bottom wall 40 and is approximately 2×3¼ inches in rectangular cross-section, such conduit having spaced-apart elongated apertures 36 being approximately ½ inch high and 1¾ inches long disposed along first side 24 and approximately 2 inches apart, and similarly sized and spaced apart apertures 20 disposed along second side 18. A pair of engagement members 21 extend from top wall 38 to interlock with the poured concrete floor or other floor element. Engagement members 21 extend upwards approximately ¼ inch and are approximately 1/10 inch in width. Engagement members 21 are spaced approximately 1 inch apart and approximately 1 inch inward from the outwardly disposed first side 24 and second side 18 of conduit 26. Conduit 26 in a preferred embodiment can be made of extruded plastic.

Figure 3:
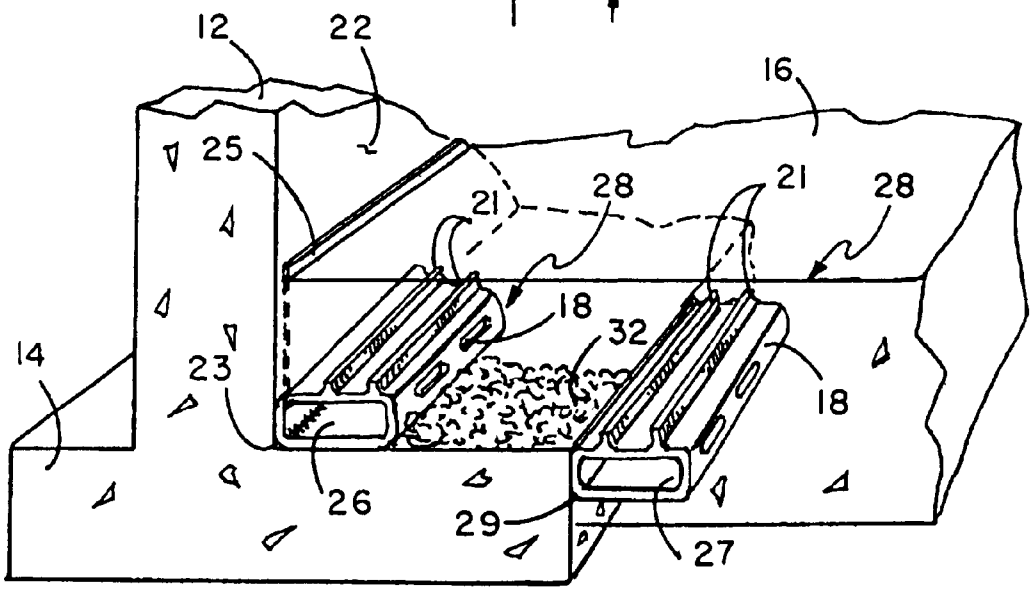
FIG. 3 illustrates a perspective view of the conduit of this invention used next to the foundation and also next to the footing.

In a first embodiment shown in FIG. 3, dual conduits can be utilized. As seen in this view first conduit 26 is placed above footing 14 adjacent to inner surface 22 of foundation wall 12 and adjacent to rubber-like sheet vapor barrier 25 which can be placed along the inner surface 22 of foundation 12. A second conduit 27 is placed immediately on the inside of inner wall 29 of footing 14. A second sheet of membrane 32 is positioned on top of footing 14 extending between first conduit 26 and second conduit 27. Such membrane can also take the form of textured cove piece material or can also be a flat rubber-like sheet of material. This embodiment is very effective in catching water that passes through foundation wall 12 and also down the inner surface of foundation wall 22 behind barrier 25 to the foundation/footing junction 23 where it passes into first conduit 26. Water also coming from footing 14 is directed away from floor 16 by membrane 32 to second conduit 27 where such water flow is then received therein and redirected by the conduit to a desired location.

Figure 4:
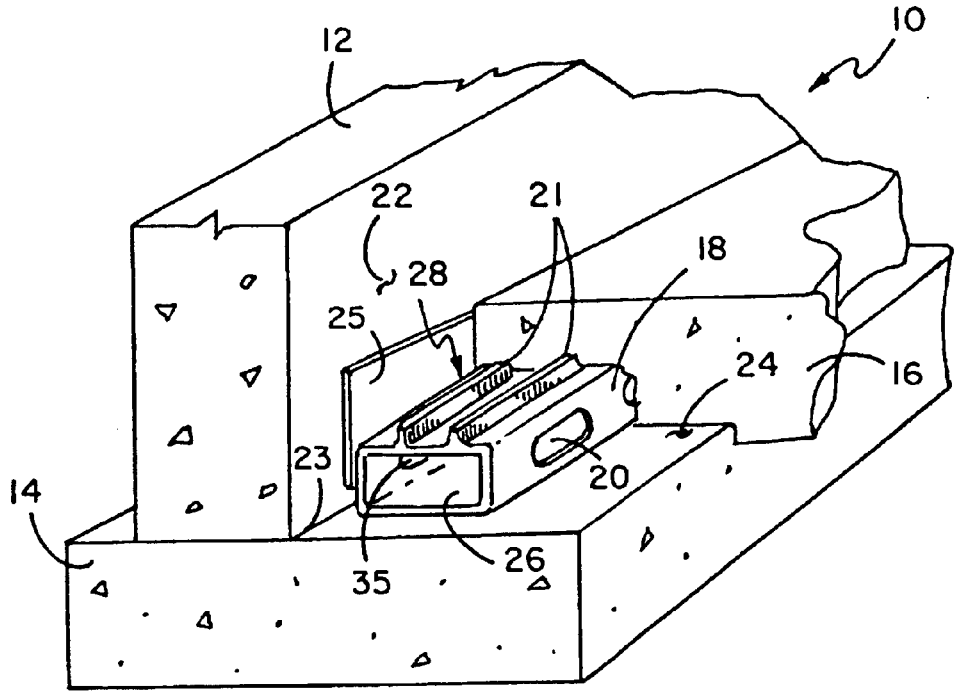
FIG. 4 illustrates a perspective view of the conduit of this invention and one method of use.

In the embodiment shown in FIG. 4 conduit 26 is shown abutting inner surface 22 of foundation wall 12 and resting on footing 14. Concrete floor 16 is poured over conduit 26 right up to inner surface 22 of foundation wall 12. Rubber-like sheet vapor barrier 25 can be disposed between conduit 26 and foundation wall 12. Barrier 25 does not extend on the way down to the foundation/footing junction 23. This methodology uses buried conduit 26 itself with its first side 24 placed flush against thin barrier 25 and foundation wall 12 to form a water collection area within the conduit to collect water seepage through and under foundation wall 12, which water passes into apertures 36 and 20 and is redirected down the length of such conduit to a remote desired location to prevent its entry into the basement.

Figure 5:
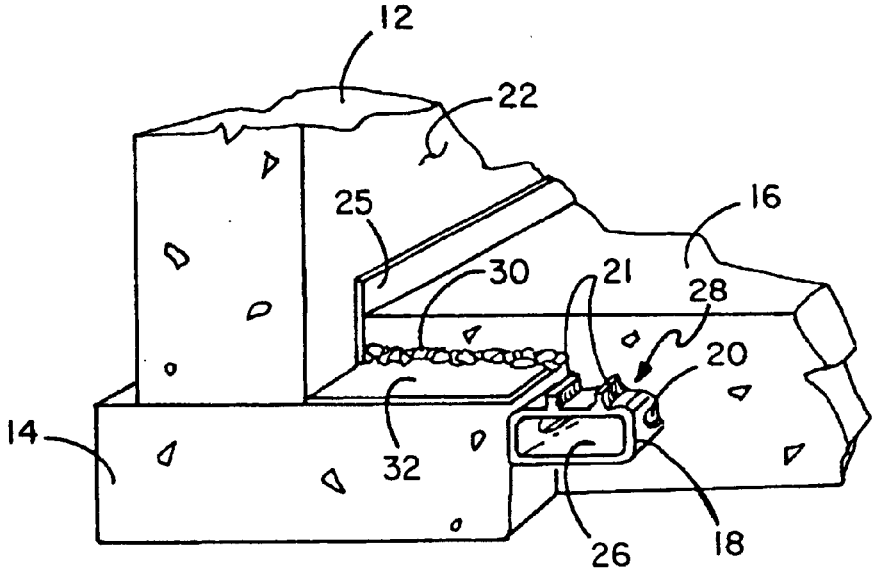
FIG. 5 illustrates a perspective view of the conduit of this invention and an alternate method of use.

FIG. 5 illustrates an alternate embodiment of the use of conduit 26 which provides for a very narrow 2-inch layer of concrete floor 16 over footing 14. This embodiment is helpful in situations where the height of existing concrete floor 16 is only a short distance above footing 14. This embodiment receives and redirects water that enters in front of footing 14 as well as over footing 14. The use of this method avoids having to use a jack hammer to remove part of the footing, the use of which would not only damage the footing, but also reduce its load-bearing capacity. In the method of this embodiment conduit 26 is installed in front of footing 14, with crushed stones 30 on membrane 32 placed above footing 14 and up to conduit 26 and with concrete floor 16 then poured over the conduit and the crushed stones. A vapor barrier 25 can be disposed between floor 16 and the inner surface 22 of foundation wall 12.

Figure 6:
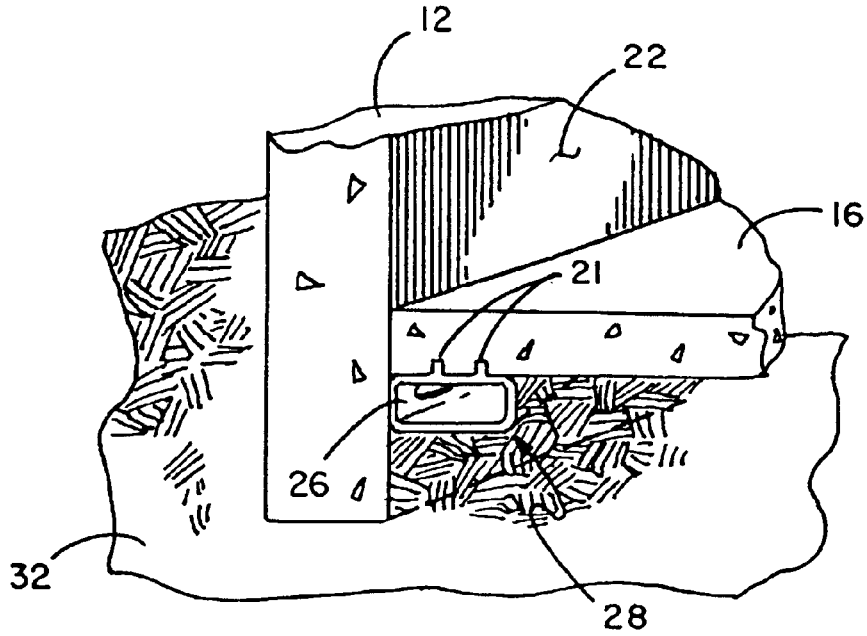
FIG. 6 illustrates a perspective view of the conduit of this invention and yet another method of use.

FIG. 6 illustrates another embodiment of the use of conduit 26 in the situation where foundation wall 12 has no footing. This embodiment can incorporate various degrees of pitch of the conduit which embodiment is useful in situations where a sump pump or discharge point cannot always be located in the lowest part of the basement. In this embodiment conduit 26 is placed in gravel 28 at the desired angle, and concrete slab floor 16 is poured thereover.

Figure 7:
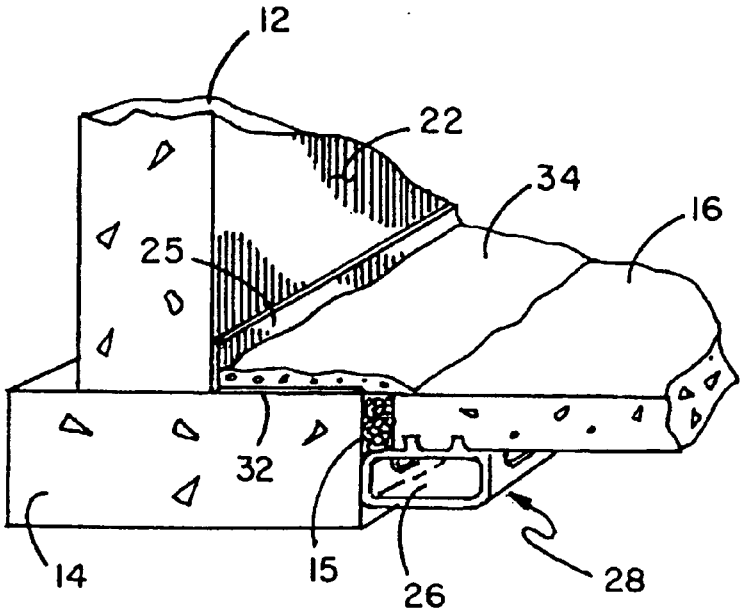
FIG. 7 illustrates a perspective view the conduit of this invention and still another method of use.

In yet another alternate embodiment of the use of conduit 26 as illustrated in FIG. 7, conduit 26 is disposed under concrete floor 16 adjacent to footing 14 where the height of floor 16 is level with the height of footing 14. A concrete berm 34 can be poured along the edge from the inner side of foundation wall 12 over crushed stones 15 located at the junction of concrete floor 16 and footing 14. In this embodiment conduit 26 can receive water both from the foundation and from in front of the footing areas. A vapor barrier 25 can be placed between concrete berm 34 and the inner surface 22 of foundation wall 12. Also a membrane sheet 32 can be positioned under berm 34 extending from the inner surface 22 of foundation wall 12 and the end of the footing to crushed stones 15.

Although the present invention has been described with reference to particular embodiments, it will be apparent to those skilled in the art that variations and modifications can be substituted therefor without departing from the principles and spirit of the invention.

I claim:

1. A method of use of a sub-basement floor conduit of the type having an elongated structure of rectangular cross section having a vertically disposed inside wall 2 inches in height having a top and a bottom, a vertically disposed outside wall 2 inches in height having a top and a bottom, a top wall horizontally disposed of approximately 3½ inches in length joining said tops of said inside and outside walls, and a bottom wall horizontally disposed of approximately 3½ inches in length joining said bottoms of said inside and outside walls, a plurality of elongated apertures defined in said inside wall, each approximately ½ inch in height and 1¾ inches in length and spaced approximately 2 inches apart, and a plurality of elongated apertures defined in said outside wall, each aperture approximately ½ inch in height and 1¾ inches in length and spaced approximately 2 inches apart, and a pair of engagement members extending upwards from said top wall and extending along the length of said conduit, each engagement member being approximately 1/10 inch in width and ¼ inch in height, such conduit to be installed in a building structure having a foundation wall resting on a footing having a top, comprising the steps of:

placing said conduit with its bottom on the top of said footing and its outside wall against said foundation wall;

pouring concrete over said conduit to form a concrete floor;

interlocking said engagement members within said concrete floor; and draining water entering through and under said foundation wall through said apertures in said conduit down the length of said conduit to a remote desired location.

2. A method of use of a sub-basement floor conduit of the type having an elongated structure of rectangular cross section having a vertically disposed inside wall 2 inches in height having a top and a bottom, a vertically disposed outside wall 2 inches in height having a top and a bottom, a top wall horizontally disposed of approximately 3½ inches in length joining said tops of said inside and outside walls, and a bottom wall horizontally disposed of approximately 3½ inches in length joining said bottoms of said inside and outside walls, a plurality of elongated apertures defined in said inside wall, each approximately ½ inch in height and 1¾ inches in length and spaced approximately 2 inches apart, and a plurality of elongated apertures defined in said outside wall, each aperture approximately ½ inch in height and 1¾ inches in length and spaced approximately 2 inches apart, and a pair of engagement members extending upwards from said top wall and extending along the length of said conduit, each engagement member being approximately 1/10 inch in width and ¼ inch in height, such conduit to be installed in a building structure having a foundation wall resting on a footing having a top, comprising the steps of:

positioning said inside wall of said conduit adjacent to the inside wall of said footing;

positioning a membrane on top of said footing between said foundation wall and said conduits;

depositing crushed stones above said membrane on top of said footing between said foundation wall and the inside wall of said footing;

pouring concrete to form a basement floor above and around said conduit and crushed stone; and interlocking said engagement members within said poured concrete; and draining water entering through and under said foundation wall through said apertures in said conduit down the length of said conduit to a remote desired location.

3. A method of use of a sub-basement floor conduit of the type having an elongated structure of rectangular cross section having a vertically disposed inside wall 2 inches in height having a top and a bottom, a vertically disposed outside wall 2 inches in height having a top and a bottom, a top wall horizontally disposed of approximately 3½ inches in length joining said tops of said inside and outside walls, and a bottom wall horizontally disposed of approximately 3½ inches in length joining said bottoms of said inside and outside walls, a plurality of elongated apertures defined in said inside wall, each approximately ½ inch in height and 1¾ inches in length and spaced approximately 2 inches apart, and a plurality of elongated apertures defined in said outside wall, each aperture approximately ½ inch in height and 1¾ inches in length and spaced approximately 2 inches apart, and a pair of engagement members extending upwards from said top wall and extending along the length of said conduit, each engagement member being approximately 1/10 inch in width and ¼ inch in height, such conduit to be installed in a building structure having a foundation wall resting on a footing having a top, comprising the steps of:

positioning said inside wall of said conduit adjacent to the inside wall of said footing;

depositing crushed stones above said conduit adjacent to the inside of said footing;

pouring a concrete floor above said conduit up to said crushed stone;

interlocking said engagement members within said poured concrete;

forming a berm extending from said foundation wall over said footing, said crushed stones and a portion of said poured concrete floor; and draining water entering through and under said foundation through said apertures in said conduit down the length of said conduit to a remote desired location.

4. A method of use of a sub-basement floor conduit of the type having an elongated structure of rectangular cross section having a vertically disposed inside wall 2 inches in height having a top and a bottom, a vertically disposed outside wall 2 inches in height having a top and a bottom, a top wall horizontally disposed of approximately 3½ inches in length joining said tops of said inside and outside walls, and a bottom wall horizontally disposed of approximately 3½ inches in length joining said bottoms of said inside and outside walls, a plurality of elongated apertures defined in said inside wall, each approximately ½ inch in height and 1¾ inches in length and spaced approximately 2 inches apart, and a plurality of elongated apertures defined in said outside wall, each aperture approximately ½ inch in height and 1¾ inches in length and spaced approximately 2 inches apart, and a pair of engagement members extending upwards from said top wall and extending along the length of said conduit, each engagement member being approximately 1/10 inch in width and ¼ inch in height, such conduit to be installed in a building structure having a foundation wall resting on a footing having a top, comprising the steps of:

providing a first conduit of the type described above;

positioning a membrane against said foundation wall;

positioning said inside wall of said first conduit adjacent to said foundation wall and said membrane with said bottom wall of said conduit positioned on the top of said footing;

providing a second conduit of the type described above;

positioning said inside wall of said second conduit adjacent to said inside wall of said footing;

disposing a second membrane above said footing between said first conduit and said second conduit;

pouring a concrete floor over said first and second conduits, footing and second membrane;

interlocking said engagement members of said first and second conduits within said concrete; and draining water entering through and under said foundation through said apertures in said first and second conduits down said lengths of said first and second conduits to a remote desired location.

5. A method of use of a sub-basement floor conduit of the type having an elongated structure of rectangular cross section having a vertically disposed inside wall 2 inches in height having a top and a bottom, a vertically disposed outside wall 2 inches in height having a top and a bottom, a top wall horizontally disposed of approximately 3½ inches in length joining said tops of said inside and outside walls, and a bottom wall horizontally disposed of approximately 3½ inches in length joining said bottoms of said inside and outside walls, a plurality of elongated apertures defined in said inside wall, each approximately ½ inch in height and 1¾ inches in length and spaced approximately 2 inches apart, and a plurality of elongated apertures defined in said outside wall, each aperture approximately ½ inch in height and 1¾ inches in length and spaced approximately 2 inches apart, and a pair of engagement members extending upwards from said top wall and extending along the length of said conduit, each engagement member being approximately 1/10 inch in width and ¼ inch in height, such conduit to be installed in a building structure having a foundation wall resting on a footing having a top, comprising the steps of:

providing said conduit adjacent to said foundation wall;

embedding said bottom wall and outside wall of said conduit in gravel;

pouring concrete above said gravel, top wall of said conduit and up to said foundation wall to form a floor;

interlocking said engagement members within said poured concrete; and draining water entering through and under said foundation through said apertures in said conduit down said length of said conduit to a remote desired location.

* * * * *